US007311621B2

(12) United States Patent
Sullivan et al.

(10) Patent No.: US 7,311,621 B2
(45) Date of Patent: Dec. 25, 2007

(54) FISH-HOLDING ARROWHEAD

(76) Inventors: Kevin Michael Sullivan, 633 Ramey Rd., Lakemont, GA (US) 30552; Dennis Edward Sullivan, 1474 Camp Creek Rd., Lakemont, GA (US) 30552

( * ) Notice: Subject to any disclaimer, the term of this patent is extended or adjusted under 35 U.S.C. 154(b) by 0 days.

(21) Appl. No.: 11/031,817

(22) Filed: Jan. 7, 2005

(65) Prior Publication Data

US 2006/0154757 A1 Jul. 13, 2006

(51) Int. Cl.
*F42B 6/08* (2006.01)

(52) U.S. Cl. ..... 473/583

(58) Field of Classification Search ..... 473/583, 473/584

See application file for complete search history.

(56) References Cited

U.S. PATENT DOCUMENTS

| | | | |
|---|---|---|---|
| 319,791 | A | 6/1885 | Conway |
| 578,717 | A | 3/1897 | Budlong |
| 859,063 | A | 7/1907 | Henson |
| 1,098,646 | A | 2/1914 | Stager |
| 1,358,795 | A | 11/1920 | Stillwell |
| 1,604,713 | A | 10/1926 | Norlund |
| 2,289,284 | A | 7/1942 | Chandler |
| 2,568,417 | A | 9/1951 | Steinbacher |
| 2,620,190 | A | 12/1952 | Bean |
| 2,820,634 | A | 1/1958 | Vance |
| 2,939,708 | A | 6/1960 | Scheib |
| 2,940,758 | A | 6/1960 | Richter |
| 2,993,697 | A | 7/1961 | Urban |
| 3,000,635 | A | 9/1961 | Nieman |
| 3,014,305 | A | 12/1961 | Yurchich |
| 3,022,077 | A | 2/1962 | Doonan |
| 3,036,395 | A | 5/1962 | Nelson |
| 3,036,396 | A | 5/1962 | Swails |
| 3,064,977 | A | 11/1962 | Zwickey |
| 3,138,383 | A | 6/1964 | McKinzie |
| 3,168,313 | A | 2/1965 | Lint |
| 3,241,836 | A | 3/1966 | Zwickey |
| 3,578,328 | A | 5/1971 | Rickey |
| 3,600,835 | A | 8/1971 | Hendricks |
| 3,738,657 | A | 6/1973 | Cox |
| 3,759,519 | A | 9/1973 | Palma |
| 4,099,720 | A | 7/1978 | Zeren |
| 4,166,619 | A | 9/1979 | Bergmann et al. |
| 4,452,460 | A | 6/1984 | Adams |
| 4,504,063 | A | 3/1985 | LeBus |
| D279,813 | S | 7/1985 | Palizzolo |
| 4,565,377 | A | 1/1986 | Troncosco, Jr. et al. |

(Continued)

*Primary Examiner*—John A. Ricci
(74) *Attorney, Agent, or Firm*—Kilpatrick Stockton LLP

(57) ABSTRACT

An arrowhead comprises an elongated body having front and rear ends, means at the front end of the body for accepting an arrowhead tip, and means at the rear end of the body for coupling the body to an arrow shaft. At least one blade or barb member is pivotably mounted to the body such that the blade member is movable between a first position, in which the free end of the blade is disposed rearward of the mounting location and a major portion of the blade is positioned adjacent the body, and a second position, in which the free end of the blade is disposed radially outward of the mounting location. A flexible ring is disposed around the circumference of the body, and a notch formed in the blade member is configured to engage the flexible ring to releasably retain the blade member in the first position.

10 Claims, 4 Drawing Sheets

U.S. PATENT DOCUMENTS 4,579,348 A 4/1986 Jones
4,600,343 A 7/1986 Frerejacques
4,615,529 A 10/1986 Vocal
4,729,320 A 3/1988 Whitten, III
4,807,382 A 2/1989 Albrecht
4,901,467 A * 2/1990 Stolpe ..... 43/6
4,932,671 A 6/1990 Anderson, Jr.
4,940,246 A 7/1990 Stagg
4,973,060 A 11/1990 Herzing
4,976,443 A 12/1990 DeLucia
4,988,112 A 1/1991 Anderson et al.
4,998,738 A 3/1991 Puckett
5,044,640 A 9/1991 DelMonte et al.
5,046,744 A 9/1991 Eddy
5,066,021 A 11/1991 DeLucia
5,078,407 A 1/1992 Carlston et al.
5,082,292 A 1/1992 Puckett et al.
5,083,798 A 1/1992 Massey
5,090,709 A 2/1992 Johnson
5,100,143 A 3/1992 Puckett
5,102,147 A 4/1992 Szeluga
5,112,063 A 5/1992 Puckett
5,172,916 A 12/1992 Puckett
5,178,398 A 1/1993 Eddy
5,286,035 A 2/1994 Ward
5,322,297 A 6/1994 Smith
5,394,859 A 3/1995 Janeway
5,458,341 A 10/1995 Forrest et al.
5,472,213 A 12/1995 Dudley
5,564,713 A 10/1996 Mizek et al.
5,803,844 A 9/1998 Anderson
5,803,845 A 9/1998 Anderson
5,820,498 A 10/1998 Maleski
5,857,930 A 1/1999 Troncoso
5,879,252 A 3/1999 Johnson
5,941,784 A 8/1999 Mizek
6,165,086 A 12/2000 Liechty, II
6,174,252 B1 1/2001 Mizek
6,217,467 B1 * 4/2001 Maleski ..... 473/583
6,258,000 B1 * 7/2001 Liechty, II ..... 473/583
6,270,435 B1 * 8/2001 Sodaro ..... 473/583
6,398,676 B1 6/2002 Mizek
6,428,433 B1 8/2002 Liechty, II
6,554,727 B1 * 4/2003 Armstrong et al. ..... 473/584
6,669,586 B2 12/2003 Barrie et al.
6,739,992 B2 5/2004 Kummerle

* cited by examiner

FISH-HOLDING ARROWHEAD

TECHNICAL FIELD

The present invention relates generally to arrowheads, and relates more specifically to arrowheads with pivotably mounted blades or barbs which fold against the body for flight and deploy only after penetrating the target.

BACKGROUND OF THE INVENTION

Arrowheads are known in which blades or barbs are folded against the body while the arrow is in flight and then open on or after impact with the target. Having the blades folded against the body during flight increases the aerodynamic efficiency, penetration, and accuracy of the arrowhead. Arrowheads suitable for bow fishing have their blades folded rearward against the body during flight. The blades are pivotably mounted at their forward ends, and the blades remain folded against the body after contact with the target Once the arrow has penetrated into or through the body of the fish, if the struggling fish begins to work his way off the arrow, beveled surfaces at the rearward edges of the blades engage the fish and force the blades open, preventing the fish from sliding off the arrow. An example of such an arrowhead is shown in U.S. Pat. No. 6,793,596, which patent is hereby incorporated by reference.

SUMMARY OF THE INVENTION

Stated generally, the present invention pertains to an arrowhead comprising a body having a first end, a mounting location, a second end, and a longitudinal axis extending between the first and second ends. An elongated blade has a first end pivotably mounted to the mounting location of the body about an axis of rotation such that the blade is pivotably movable between first and second positions. When in the first position, the blade lies substantially parallel to the longitudinal axis of the body with the second end extending rearward of the mounting location. When in the second position, the second end of the blade extends substantially radially outward from the body.

A retention means operatively associated with the arrowhead body and the blades releasably retains the blades in the first position. In the disclosed embodiments the retention means comprises a flexible ring disposed around the circumference of the body. A notch formed in the blade engages the flexible ring to retain the blade in the first position.

The blade has a bearing surface formed at the second end of the blade so as to be contacted by a target surface to pivot the blade from the first position to the second position when the bearing surface confronts the target surface. In the disclosed embodiment the bearing surfaces on the second ends of the blades face rearward when the blades are in their first position. This arrowhead is suitable for bow fishing. When the arrow penetrates a fish, if the arrow tries to pull back through the fish, the blades will deploy substantially perpendicular to the longitudinal axis of the arrowhead body upon contact with the distal surface of the fish to prevent the arrowhead from passing back through the hole in the fish.

Objects, features, and advantages of the present invention will become apparent upon reading the following specification, when taken in conjunction with the drawings and the appended claims.

DETAILED DESCRIPTION OF THE DISCLOSED EMBODIMENTS

Figure 1:
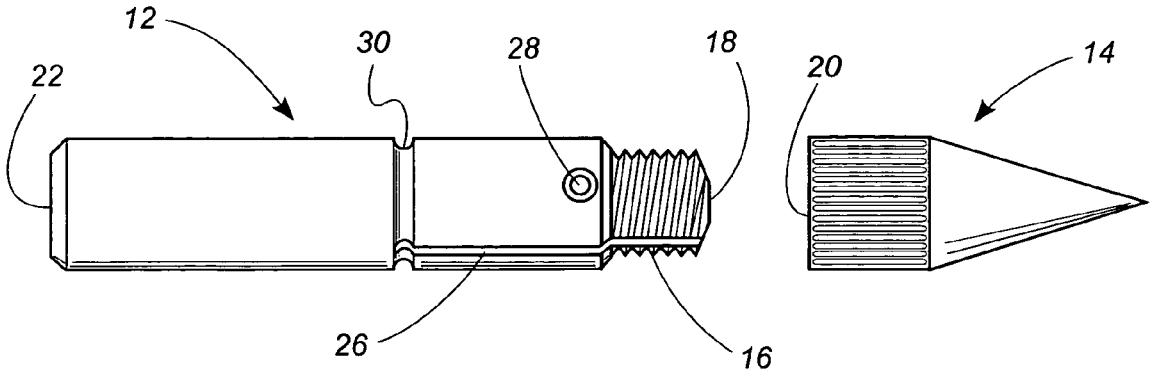
FIG. 1 is a side view of an arrowhead body and tip for use in an arrowhead according to the disclosed invention.

Referring now in more detail to the drawings, in which like numerals indicate like elements throughout the several views, FIG. 1 illustrates an arrowhead body 12 and an arrowhead tip 14. The arrowhead body 12 has a threaded boss 16 at its forward end 18, which is dimensioned to engage a corresponding threaded bore in the rearward end 20 of the tip 14. The arrowhead body 12 has an axial bore in its rearward end 22 which is configured to engage the tip of an arrow shaft (not shown).

Just rearward of the forward end 18 of the arrowhead body 12, a plurality of longitudinal slots 26 are formed around the periphery of the arrowhead body. In the disclosed embodiment there are three slots 26 spaced at 120° intervals to accommodate three blades, as will be shown below. However, it will be understood that a greater or lesser number of slots 26 may be provided, depending upon the number of blades desired.

Figure 2:
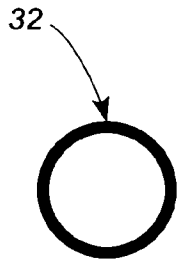
FIG. 2 is a front view of an O-ring for use in an arrowhead according to the disclosed invention.
Figure 3:
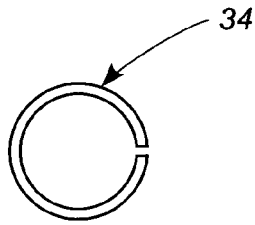
FIG. 3 is a front view of a split ring for use in an arrowhead as an alternative to the O-ring of FIG. 2.

Transverse to and in communication with each of the slots 26 is a bore 28. The bores 28 are transverse to and radially offset from the longitudinal axis of the arrowhead body 12. Each bore 28 of the disclosed embodiment is open at only one end, though a through hole is equally functional. At the rearward edge of the slots, a circumferential channel 30 is formed. The circumferential channel is adapted to receive either a rubber O-ring 32 (FIG. 2) or a split ring 34 (FIG. 3) of metal, plastic, or the like.

Figure 4:
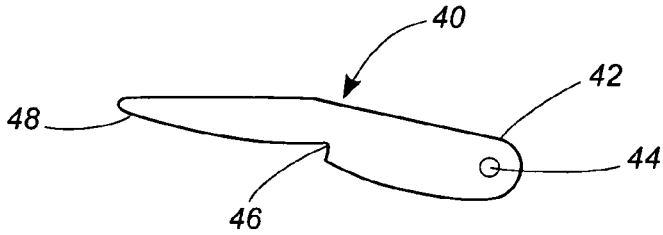
FIG. 4 is a side view of a blade for use in an arrowhead according to the disclosed invention.

FIG. 4 illustrates a blade 40 for use with the arrowhead body 12 of FIG. 1. Because the blade is adapted to prevent a fish from coming off an arrow shaft and is not adapted to penetrate or to cut the target, the blade has a blunt periphery devoid of sharp edges. The blade has a head portion 42 having a hole 44 therethrough. A notch 46 is formed in the lower portion of the blade 40. At the free end of the blade is a beveled edge 48.

Figure 5:
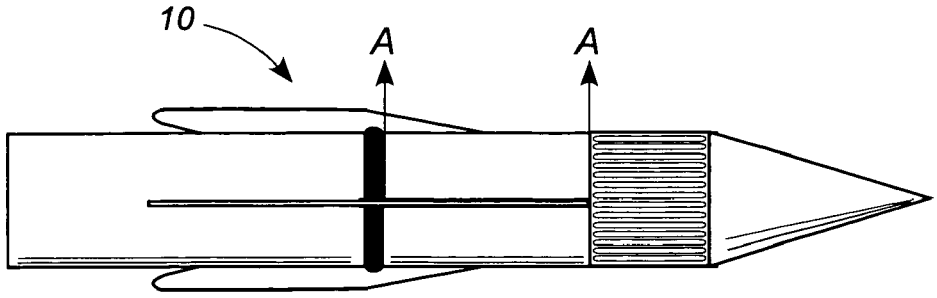
FIG. 5 is a side view of an assembled arrowhead comprising the arrowhead tip and body of FIG. 1 and the O-ring of FIG. 2.
Figure 6:
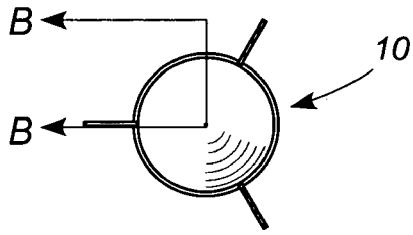
FIG. 6 is a front view of the arrowhead of FIG. 5.
Figure 7:
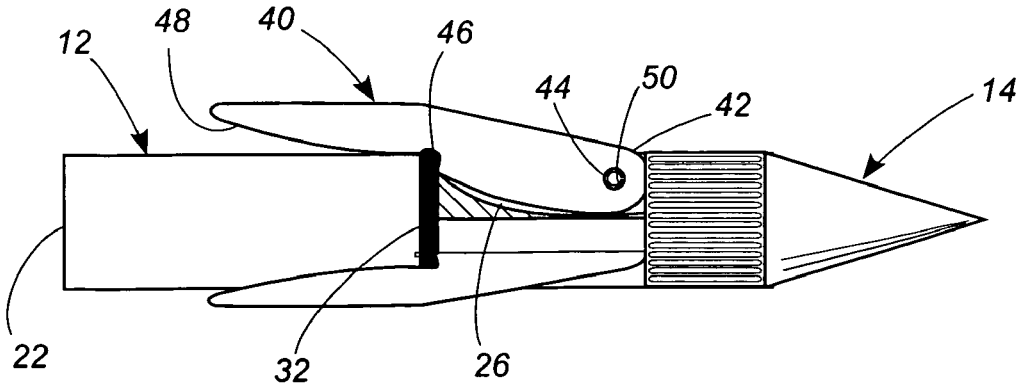
FIG. 7 is a side view of the arrowhead of FIG. 5 rotated 90° clockwise and cut away along lines A-A of FIG. 5 and B-B of FIG. 6.
Figure 8:
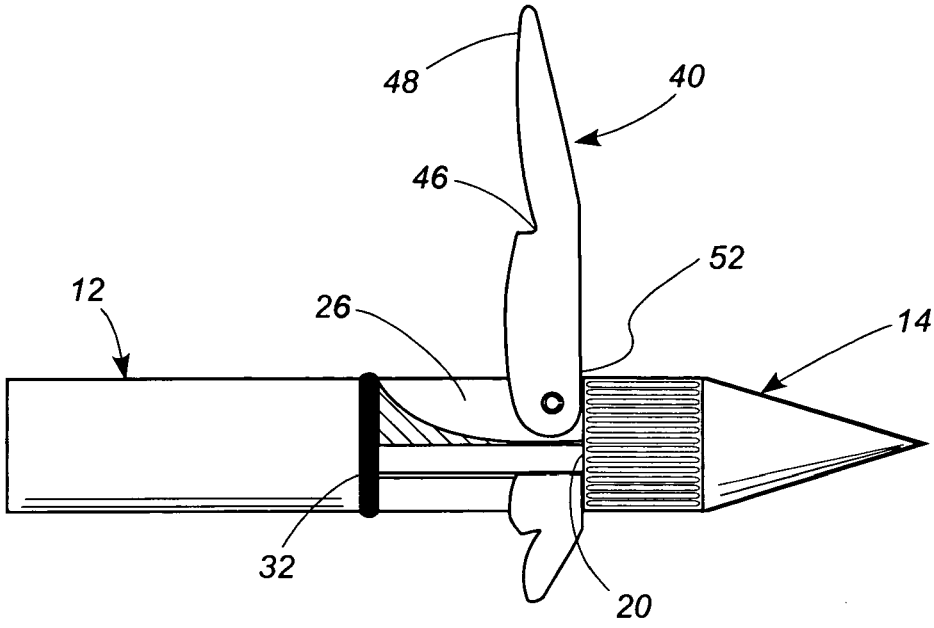
FIG. 8 is a side view of the arrowhead of FIG. 7 showing the blades extended in a deployed position.
Figure 9:
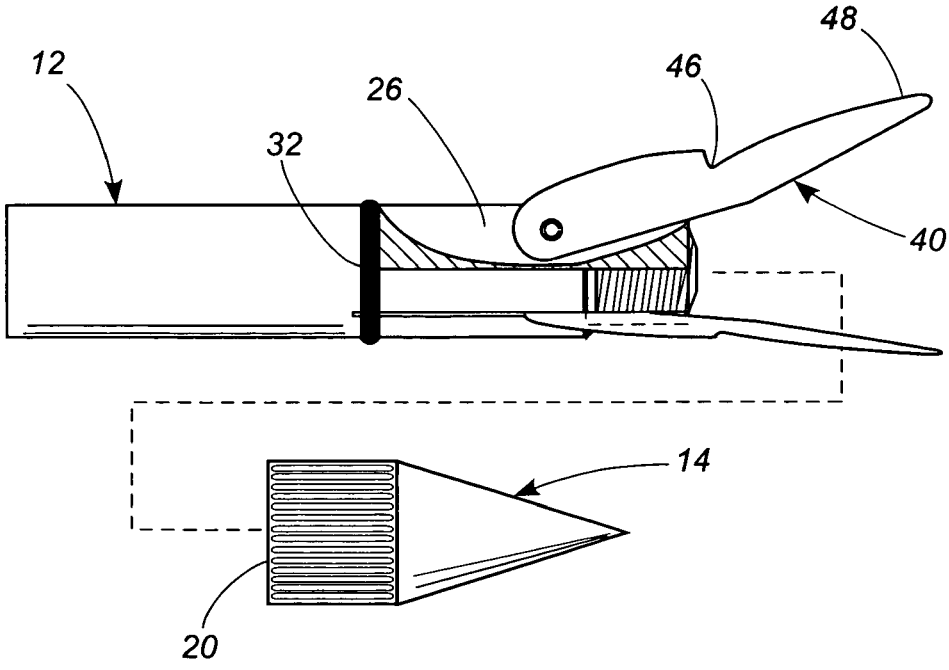
FIG. 9 is a side view of the arrowhead of FIG. 7 with the tip removed and the blades pivoted forward for removal of the arrow from a target.

FIGS. 5 and 6 are assembled views of an arrowhead 10 comprising the arrowhead body 12, tip 14, O-ring 32, and blade 40 and are included only to show section lines A-A and B-B, which indicate the cutaway portions of FIGS. 7-9.

Assembly of the arrowhead 10 will now be explained with reference to FIG. 7. The head portion 42 of a blade 40 is inserted into each longitudinal slot 26 of the arrowhead body 12. The blades are aligned such that the holes 44 in the blades are aligned with the bores 28 (FIG. 1) in the arrowhead body 12. A roll pin 50, also known as a spring pin or split pin, is inserted into the open end of each bore 28 and through the hole 44 in the head portion 42 of the corresponding blade 40. The roll pins 50 are retained snugly within the bores 28, and the blades 40 pivot freely on the roll pins.

Also shown in FIG. 7, an O-ring 32 has been advanced over the rearward end 22 of the arrowhead body 12 and seated into the circumferential channel 30 (FIG. 1). In the alternative, a split ring 34 can be spread and advanced over the rearward end 22 of the arrowhead body 12 and seated into the circumferential channel 30.

Operation of the arrowhead 10 will now be explained with reference to figures 7-9. Referring first to figure 7, the notches 46 in the blades 40 engage the rubber O-ring 32 to retain the blades in a first, retracted position. The blades 40 remain in the retracted position, retained by the O-ring 32, during flight and during penetration of the target by the arrowhead.

Referring now to figure 8, when a struggling fish tries to back off the arrow, the distal surface of the fish will engage the beveled surfaces 48 of the blades 40, causing the notches to disengage from the O-ring 32 and causing the blades to pivot to a second, extended position shown in FIG. 8. The upper surfaces 52 of the blades 40 confront the rearward edge 20 of the tip 14 to prevent the blades from rotating any farther forward. The deployed blades prevent the arrowhead from being withdrawn from the fish.

When it is desired to remove the fish from the arrow, the rip 14 is unscrewed from the arrowhead body 12, as shown in figure 9. The blades 40 are thereafter free to pivot further forward to a third position as shown in figure 9, creating a sufficiently small profile that the arrowhead can be withdrawn through the fish.

When it is desired to reuse the arrowhead 10, the blades are pivoted back to their retracted position (FIG. 7), where the notches once again engage the rubber O-ring. The tip is then screwed back onto the arrowhead body 12, and the arrowhead is ready for reuse.

The O-ring serves as a retention means by flexing when the notch 46 of the blade 40 engages it. Thus it is not required that the O-ring be comprised of rubber. Rather, any suitable flexible material can be substituted.

In contrast to the O-ring, the split ring 34 comprises a relatively rigid material formed into a flexible structure, rather than a structure comprised of a flexible material. The retention means functions in the same manner however, namely, that the split ring 34 flexes when the notch of the arrow engages it to hold the blade in the retracted position.

Figure 10:
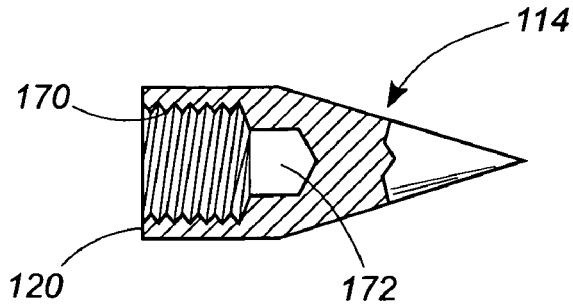
FIG. 10 is a partially cutaway view of an arrowhead tip of an alternate embodiment.

FIGS. 10-14 illustrate an alternate embodiment of an arrow head tip 114. Referring first to FIG. 10, the arrowhead tip 114 has a threaded bore 170 formed in its rearward face 120. A smooth counterbore 172 is formed coaxially with the threaded bore 170.

Figure 11:
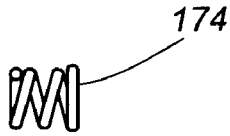
FIG. 11 is a coil spring for use with the arrowhead tip of FIG. 10.
Figure 12:
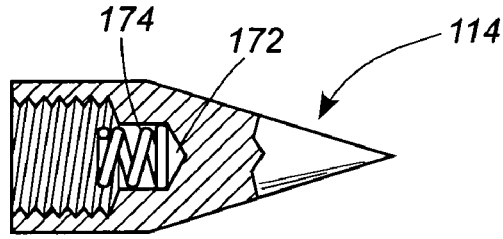
FIG. 12 is a partially cutaway view of the arrowhead tip of FIG. 10 with the coil spring of FIG. 11 positioned therewithin.

FIG. 11 illustrates a coil spring 174. In FIG. 12, the coil spring 174 is shown located within the smooth counterbore 172 of the arrowhead tip 114. When the arrowhead tip 114 with coil spring 174 is screwed onto the threaded boss 16 of an arrowhead body 12, the coil spring bears against the tip 18 of the arrowhead body. The spring 174 exerts a tension between the tip 114 and the arrowhead body 12 which prevents the tip from accidentally loosening.

Figure 13:
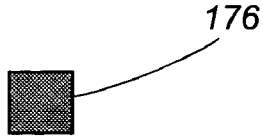
FIG. 13 is a cylindrical member of a deformable, resilient material such as rubber.
Figure 14:
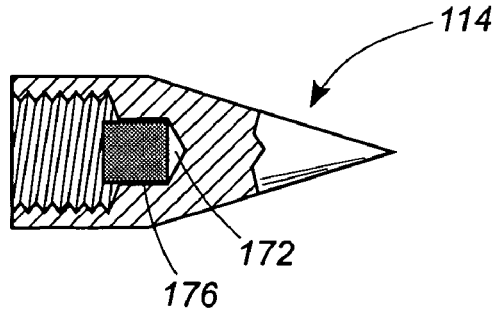
FIG. 14 is a partially cutaway view of the arrowhead tip of FIG. 10 with the cylindrical member of FIG. 13 positioned therewithin.

FIG. 13 illustrates a cylinder 176 of a deformable, resilient material such as rubber. FIG. 14 illustrates the cylinder 176 disposed within the smooth counterbore 172 of the arrowhead tip 114. When the arrowhead tip 114 with the cylinder 176 of deformable, resilient material is screwed onto the threaded boss 16 of an arrowhead body 12, the deformable, resilient material bears against the tip 18 of the arrowhead body. The spring effect of the deformable, resilient material exerts a tension between the tip 114 and the arrowhead body 12 which prevents the tip from accidentally loosening.

While the foregoing embodiments have all been disclosed with respect to an arrowhead having blades, it will be appreciated that the primary function of the blades is not to cut or to penetrate the target but to retain the arrowhead on the target once penetrated. Toward this end, barbs are a suitable alternative to blades. In the claims which follow, blades, barbs, and structural equivalents will be referred to collectively as grappling means.

Finally, it will be understood that the preferred embodiments have been disclosed by way of example, and that other modifications may occur to those skilled in the art without departing from the scope and spirit of the appended claims.

What is claimed is:

1. An arrowhead comprising:

a body having a forward end, a mounting location, a rearward end, and a longitudinal axis extending between said forward and rearward ends;

an arrowhead tip removably mounted to said forward end of said body;

an elongated grappling means having a first end and a second end, said first end of said grappling means being pivotably mounted to said mounting location of said body about an axis of rotation such that said grappling means is pivotably movable between first, second, and third positions;

said grappling means lying substantially parallel to said longitudinal axis of said body when in said first position with said second end extending rearward of said mounting location, said second end of said grappling means extending substantially radially outward when said grappling means is in said second position, and said grappling means lying substantially parallel to said longitudinal axis of said body when in said third position with said second end extending forward of said mounting location;

a bearing surface at said second end of said grappling means so as to be contacted by a target surface to pivot said grappling means from said first position to said second position when said bearing surface confronts said target surface; and said grappling means confronting said tip when in said second position so as to prevent said grappling means from rotating to said third position until said tip has been removed from said body.

2. The arrowhead of claim 1, wherein said arrowhead body has a longitudinal groove formed therein;

wherein said grappling means in said first position is folded against said arrowhead body with a substantial portion of said grappling means residing within said longitudinal groove;

wherein said bearing surface at said second end of said grappling means is disposed rearward of said mounting location when said grappling means is in said first position; and wherein said bearing surface impacts upon a target surface after said arrowhead has passed into or through a target and is being pulled back through the target, thereby causing said grappling means to rotate from said first position to said second position.

3. The arrowhead of claim 1, wherein said grappling means comprises a circular hole therethrough, and wherein said grappling means is pivotably mounted to said arrowhead body by a pivot pin mounted to said arrowhead body coaxial with said axis of rotation and extending through said circular hole in said grappling means.

4. The arrowhead of claim 3, wherein said pivot pin comprises a roll pin.

5. The arrowhead of claim 1, further comprising retention means operatively associated with said arrowhead body and said grappling means for releasably retaining said grappling means in said first position.

6. The arrowhead of claim 5, wherein said retention means operatively associated with said arrowhead body and said grappling means for releasably retaining grappling means in said first position comprises:

a flexible ring operatively associated with said arrowhead body; and engagement means operatively associated with said grappling means for engaging said flexible ring to retain said grappling means in said first position.

7. The arrowhead of claim 6, wherein said flexible ring comprises a ring formed from a flexible material.

8. The arrowhead of claim 6, wherein said flexible ring comprises a split ring.

9. The arrowhead of claim 6, wherein said flexible ring operatively associated with said arrowhead body comprises an annular recess formed in the circumference of said arrowhead body, said flexible ring being seated within said annular recess.

10. The arrowhead of claim 6, wherein said engagement means operatively associated with said grappling means comprises a notch in the periphery of said grappling means.

* * * * *